United States Patent [19]

Marrello

[11] Patent Number: 5,054,779

[45] Date of Patent: Oct. 8, 1991

[54] TENNIS RACQUET

[76] Inventor: Hugo Marrello, 119 Elgin Street, Thornhill, Ontario, Canada, L3T 1W7

[21] Appl. No.: 515,685

[22] Filed: Apr. 26, 1990

Related U.S. Application Data

[63] Continuation of Ser. No. 249,337, Sep. 26, 1988, abandoned, which is a continuation-in-part of Ser. No. 236,832, Aug. 26, 1988, abandoned, and a continuation-in-part of Ser. No. 128,381, Dec. 3, 1987, abandoned.

[51] Int. Cl.[5] ..... A63B 49/14

[52] U.S. Cl. ..... 273/73 D

[58] Field of Search ..... 273/73 R, 73 C, 73 D, 273/73 E

[56] References Cited

U.S. PATENT DOCUMENTS

| | | | |
|---|---|---|---|
| 1,502,845 | 7/1924 | Blanche . | |
| 3,083,968 | 4/1963 | Takahashi | 273/73 R |
| 3,086,777 | 4/1963 | Lacoste . | |
| 3,843,121 | 10/1974 | Edlefsen . | |
| 3,904,202 | 9/1975 | DeLorean . | |
| 3,921,979 | 11/1975 | Dischinger | 273/73 D |
| 3,968,966 | 7/1976 | D'Aquanni . | |
| 4,057,249 | 11/1977 | Reedhead et al. | 273/73 C X |
| 4,204,680 | 5/1980 | Blackburne . | |
| 4,462,592 | 7/1984 | Legger et al. . | |
| 4,591,165 | 5/1986 | Sines et al. . | |
| 4,681,319 | 7/1987 | Zilinskas | 273/73 D |
| 4,783,072 | 11/1988 | Haar | 273/73 R X |

FOREIGN PATENT DOCUMENTS

| | | | |
|---|---|---|---|
| 2715869 | 10/1978 | Fed. Rep. of Germany . | |
| 873589 | 3/1942 | France | 273/73 D |
| 2586935 | 3/1987 | France | 273/73 D |
| 2196537 | 5/1988 | United Kingdom | 273/73 D |

*Primary Examiner*—Edward M. Coven
*Assistant Examiner*—William E. Stoll
*Attorney, Agent, or Firm*—Smart & Biggar

[57] ABSTRACT

A racquet for tennis or the like, which comprises a frame with an appended handle with a plurality of guides mounted in spaced relationship along the frame in its plane. Each guide has an outwardly oriented portion concave in a plane normal to the plane of the frame and each guide is constructed of a self-lubricating and shock absorbent material. A string laced around the guides forms a ball impact grid within the frame. In one embodiment the guides are spools positioned between a pair of laterally opposed members forming the frame and in another embodiment the guides are bosses fixed to the outside of the frame with tangential apertures through the frame. In a further embodiment the guides are spools resting in sockets, or in a circumscribing channel, on the frame in its plane.

6 Claims, 3 Drawing Sheets

TENNIS RACQUET

This application is a continuation of application Ser. No. 07/249,337, filed Sept. 26/88 now abandoned, which is a continuation-in-part of U.S. patent application Ser. No. 128,381 filed Dec. 3, 1987 and a continuation-in-part application Ser. No. 236,832 filed Aug. 26, 1988, both now abandoned.

FIELD OF THE INVENTION

This invention relates to a tennis racquet or the like.

BACKGROUND OF THE INVENTION

Tennis racquets are strung with a single string which is threaded continuously through apertures in the racquet frame to form a grid, in the manner shown for instance in U.S. Pat. No. 3,843,121 issued Oct. 22, 1974 to Thomas B. Edlefson. In such a construction the string is bent at a severe angle where it engages the frame. When the grid is impacted by a ball the string stretches in those portions which are impacted but the tensile force is not distributed through the entire string because the string binds where it engages the frame. Consequently the tension in the string becomes uneven over the whole area of the grid.

To overcome this problem it has been proposed, for instance in U.S. Pat. No. 4,591,165 to Sines et al, to provide a rounded portion where the string passes over the frame, allowing the string to slip. As an alternative to slippage Sines provides a rocker element over which the string passes. In each of these embodiments a rigid material is required.

It has been discovered by the applicant that by passing the racquet string over a shock absorbent material certain unexpected advantages are obtained, namely (1) the ball rebounds faster off the string grid, (2) there is less torque on the player's wrist, and (3) there is less deflection of the racquet and therefore less vibration as well as less power required to hit the ball a given distance.

STATEMENT OF THE INVENTION

Essentially the invention consists of a racquet for tennis or the like, comprising: a circumferential frame with an appended handle; a plurality of guides mounted on the frame in spaced relationship along the frame in the plane thereof, each guide having at least an outwardly oriented portion concave transversely to the frame and being constructed of a self-lubricating and shock absorbing material; and a string laced over the guides in the concavities thereof to form a ball impact grid within the frame.

In one embodiment the guides are spools positioned between a pair of laterally opposed members forming the frame and in another embodiment the guides are bosses fixed to the outside of the frame with tangential apertures through the frame. In a further embodiment the guides are spools resting in sockets or in a circumscribing channel on the frame in its plane.

BRIEF DESCRIPTION OF DRAWINGS

Example embodiments of the invention are shown in the accompanying drawings in which.

DESCRIPTION OF PREFERRED EMBODIMENT

Figure 1:
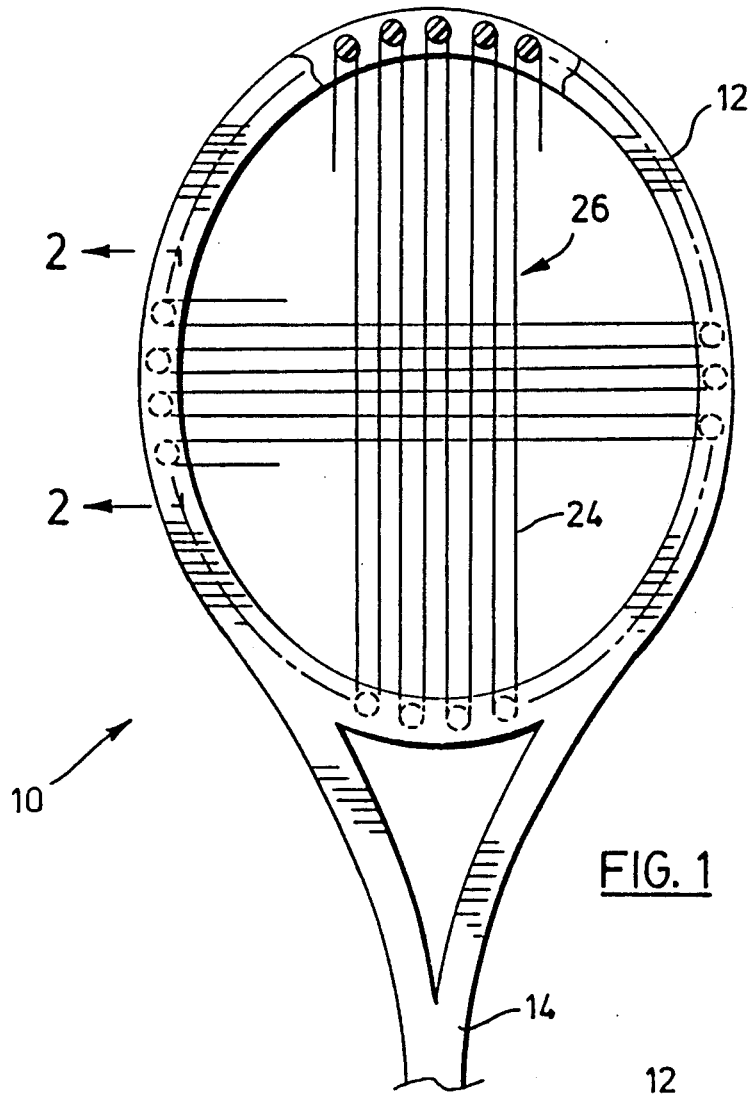
FIG. 1 shows one embodiment of a tennis racquet according to the invention.
Figure 2:
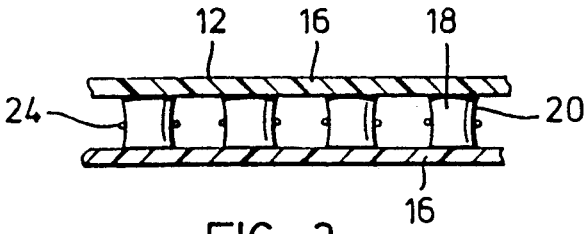
FIG. 2 is a cross-section taken along line 2—2 of FIG. 1.
Figure 3:
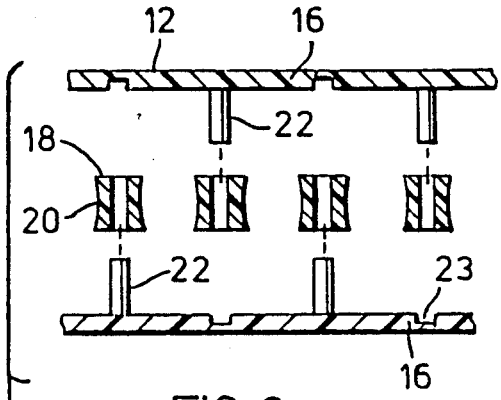
FIG. 3 is an exploded view of the section of the racquet shown in FIG. 2.

The embodiment of the invention shown in FIGS. 1 to 3 of the drawings consists of a tennis racquet 10 having an oval head or frame 12 with an appended handle 14.

Figure 4:
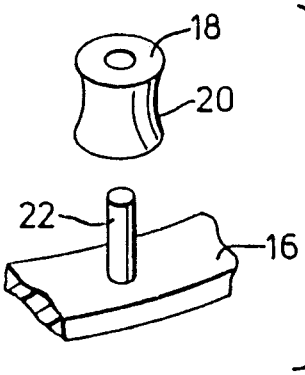
FIG. 4 is a perspective view of the spool and pin arrangement shown in FIG. 3.

Frame 12 comprises a pair of spaced members 16 which are laterally opposed to each other with respect to the plane of the frame and carry between them a plurality of spaced sheaves or guides 18 each comprising a hollow cylindrical spool of self-lubricating and shock absorbent material having a concave circumferential surface 20 with a portion of the concavity being outwardly oriented with respect to the frame and being transverse to the frame. As seen in FIGS. 3 and 4, guides 18 are mounted for free rotation each on a pin 22 fixed on one frame member 16 and extending normally from that frame member to meet the opposing frame member, the frame members being held together by the pins which press fit into holes 23 and additionally may be glued in the holes.

Frame 12 is strung by lacing a string 24 around each of guides 18 to form a ball impact grid 26.

In use, a ball striking grid 26 will produce shock and tensile forces in string 24 in the area of impact and the shock will be absorbed by guides 18 while the tension will be transmitted throughout the entire string because the string passes in an uninterrupted curve around guides 18.

Figure 5:
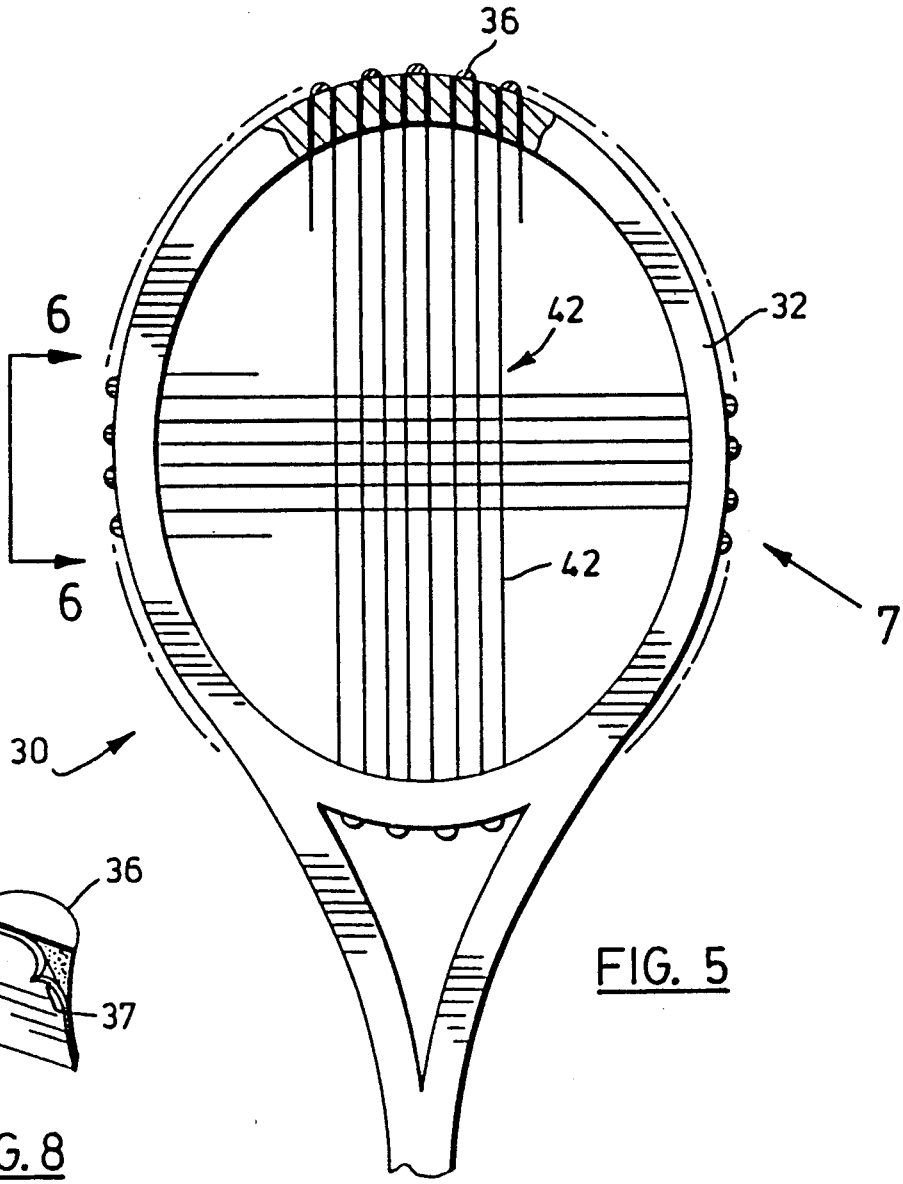
FIG. 5 shows a first alternate embodiment of the invention.
Figure 8:
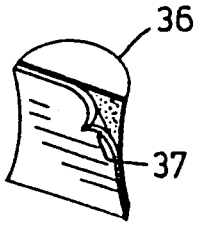
FIG. 8 shows an attachable boss of the racquet of FIG. 5.
Figure 6:
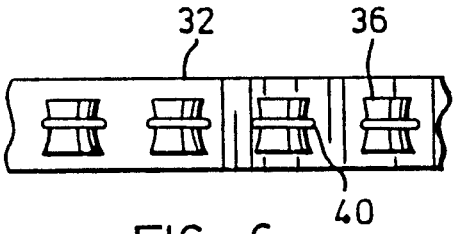
FIG. 6 is a partial side view of the racquet of FIG. 5 taken in the direction of arrows 6—6.
Figure 7:
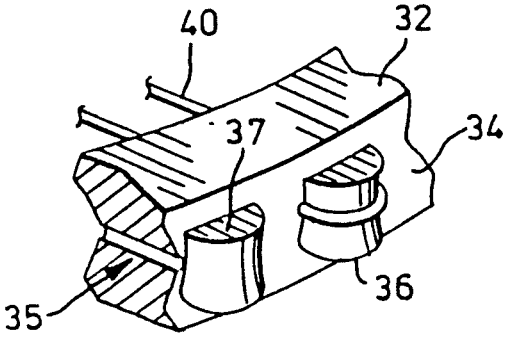
FIG. 7 is a perspective view of that portion of the racquet shown in FIG. 6.
Figure 9:
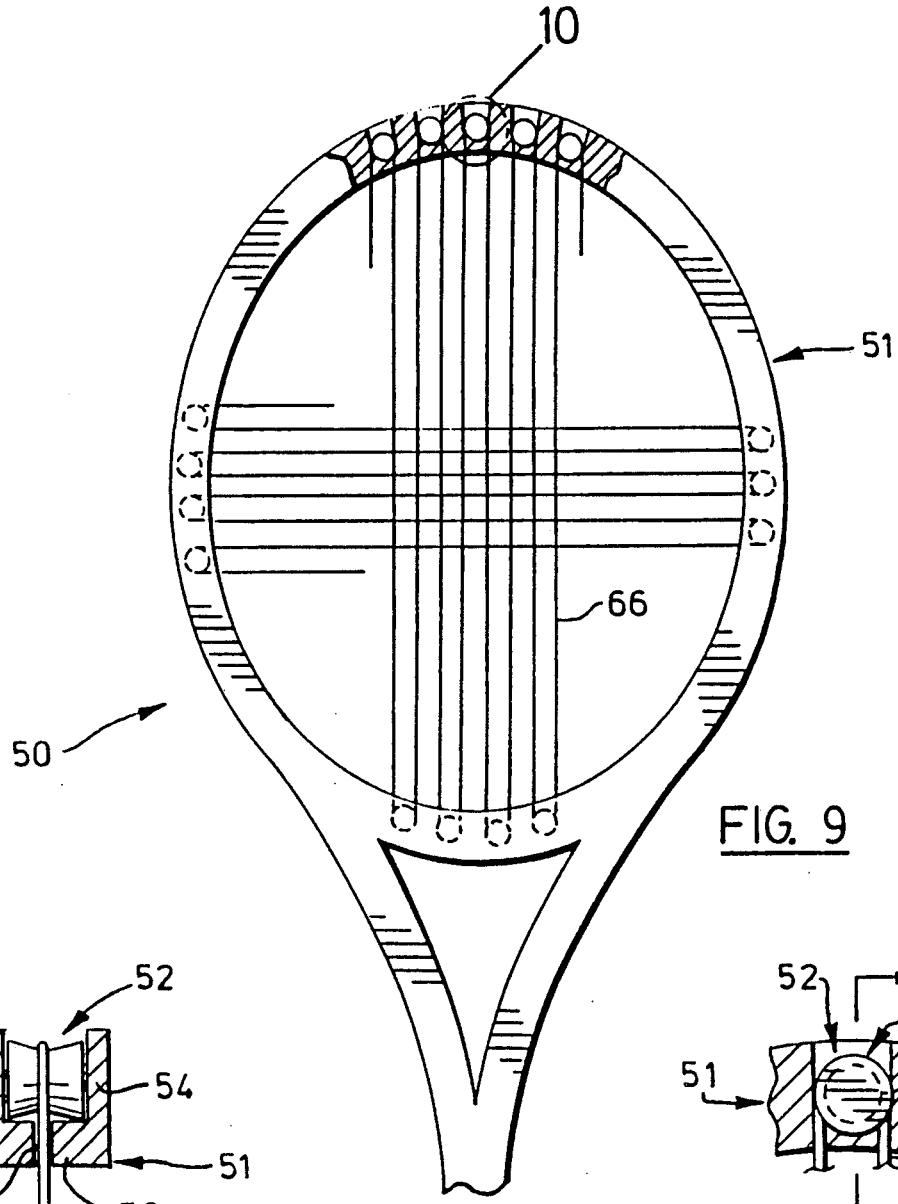
FIG. 9 shows a second alternate embodiment of the invention.
Figure 11:
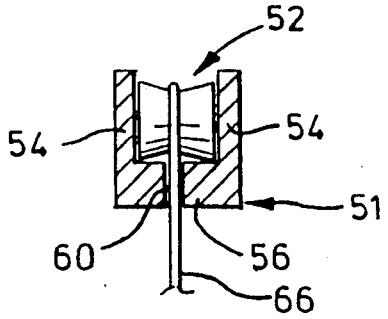
FIG. 11 is a cross-sectional view taken along line 11—11 of FIG. 10.
Figure 10:
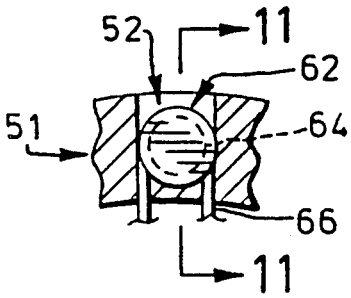
FIG. 10 is an enlarged section of the portion 10 of FIG. 9.
Figure 12:
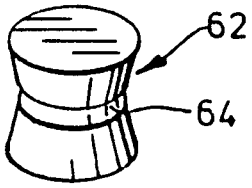
FIG. 12 is a perspective view of the spool of FIGS. 10 and 11.

The first alternate embodiment shown in FIGS. 5 to 7 of the drawings consists of a conventional racquet 30 having a solid circumferential frame 32 with an outside surface 34 in the plane of the frame and having spaced passages 35 about its circumference, the passages passing through the frame in the plane thereof to the outside surface. A ring of spaced, semi-cylindrical guides in the form of half sheaves or bosses 36 of self-lubricating and shock absorbent material are carried on surface 34 of racquet 30. Each boss 36 has a concave circumferential surface outwardly oriented with respect to the frame. Also, each boss 36 has a cylindrical diameter equal to the shortest distance between any two passages 35 whereby the passages are substantially tangential to the bosses. As seen in FIG. 8, each boss 36 may be a separate element carrying an adhesive protected by an overlying sheet of removable protective material 37 (a peeloff cover) which allows the boss to be fixed on frame 32.

Racquet 30 is prepared for stringing by adhering bosses 36 to outside surface 34 of frame 32 between each two adjacent apertures 35 as seen in FIGS. 6 and 7. Bosses 36 may be supplied in bulk for this purpose. Thereafter racquet 30 is strung by passing a string 40 through passages 35 and around bosses 36 in the usual manner to form a ball impact grid 42. If desired, bosses 36 can vary in diameter in accordance with the distance between any two passages 35 in order that string 40 will pass through the passages without touching them, thus preventing shock forces from passing into frame 32.

As in the previous embodiment, in use, the shock forces created in the string by a ball striking grid 26 will be absorbed by bosses 36 and the tensile forces will be distributed evenly throughout string 24 because the string passes around bosses 36 and has no angled bends to interfere with such forces.

The second alternate embodiment shown in FIGS. 9 to 13 of the drawings consists of a racquet 50 having a solid circumferential frame 51 with a plurality of spaced outwardly opening sockets 52 each having sidewalls 54 and a bottom 56 which has a centrally disposed ridge 58 lying in the plane of the frame. A plurality of spaced passages 60 extend through frame 50 about its circumference, one pair of adjacent passages opening into each socket 52. Guides 62, each consisting of a cylindrical spool with a concave circumferential surface 64, rest one in each socket 52 astride ridge 58, the spool being located between adjacent passages 60. A circumferential groove 65 is centrally located in surface 64 of each guide 62. Guides 62 are held in sockets 52 by stringing racquet 50 to have a string 66 pass sequentially around each guide 62. The radius of groove 65 is only slightly larger than the radius of string 66 whereby the string is able to slip along the groove but lateral movement is inhibited. Of course grooves similar to grooves 65 could be carried by guides 20 or bosses 36 in the previously described embodiments, and the grooves could comprise the concavities.

The structure of this second embodiment allows pressure to be passed directly inwardly from guides 62 against frame 51 and also allows rotational movement of the guides.

Figure 13:
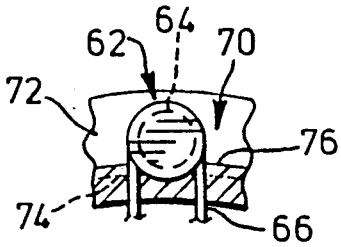
FIG. 13 is a variation in the embodiment of the racquet of FIGS. 9 to 12.

In the variation shown in FIG. 13 an outwardly opening channel 70 is located circumferentially about frame 51 in the plane of the frame. Channel 70 has a pair of opposed side walls 72 and a bottom 74 with a centrally disposed longitudinal ridge 76. Guides 62 are held in channel 70 by strings 66 as before.

Guides 18, bosses 36 and guides 62 are each formed of a self-lubricating and shock absorbent material, such as nylon, Teflon (a trade mark) or Delrin (a trade mark) or similar polymeric material, which provides a smooth, low friction and low wear surface. Such material is necessarily different from the material of frame 12 which is chosen to withstand stresses of another type.

It will be appreciated that the invention is applicable to squash racquets or racquets of like construction used in other sports, and the shape of the frame may be other than oval, for example round.

I claim:

1. A racquet for tennis or the like, comprising:

a circumferential frame with an appended handle, the frame having a plurality of outwardly opening sockets spaced circumferentially along the frame in the plane of the frame, each socket having side walls and a bottom, the bottom of each socket having a centrally disposed ridge, a pair of spaced passages in the plane of the frame opening into each of the sockets, and a plurality of guides each comprising a spool of self-lubricating and shock absorbent material, the guides each having a centrally recessed circumferential surface, the guides resting freely one in each of the sockets astride the ridge and between the pair of adjacent passages opening into said each socket, the passages being oriented substantially tangential to the guides; and a string laced through the passages and around the guides in the centrally recessed surfaces thereof to form a ball impact grid within the frame.

2. A racquet as claimed in claim 1 in which the recessed circumferential surface of each of said guides carries a centrally located circumferential groove having a radius slightly larger than the radius of the string.

3. A racquet as claimed in claim 1 in which each of said guides is formed of a polymeric material.

4. A racquet for tennis or the like, comprising:

a circumferential frame with an appended handle, the frame having an outwardly opening channel located circumferentially along the frame in the plane of the frame, the channel having a pair of opposed side walls and a bottom, the bottom having a centrally disposed longitudinal ridge, a plurality of pairs of spaced passages in the plane of the frame opening into the channel, a plurality of guides each comprising a spool of self-lubricating and shock-absorbent material, the guides each having a centrally recessed circumferential surface, one of said guides resting freely in the channel one between each of said pairs of adjacent passages opening into the channel and resting astride the ridge whereby the passages are substantially tangential to the guides; and a string laced through the passages and around the guides in the centrally recessed surfaces thereof to form a ball impact grid within the frame.

5. A racquet as claimed in claim 4 in which the recessed circumferential surface of each of said guides carries a centrally located circumferential groove having a radius slightly larger than the radius of the string.

6. A racquet as claimed in claim 4 in which each of said guides is formed of a polymeric material.

* * * * *